US005907986A

United States Patent [19]

Buchacher

[11] Patent Number: 5,907,986

[45] Date of Patent: Jun. 1, 1999

[54] LATERALLY-FLOATING FEED-ROLL DRIVE MECHANISM FOR CURVE-CUTTING MACHINE

[75] Inventor: Ernie R. Buchacher, Langley, Canada

[73] Assignee: Optimil Machinery, Inc., Delta, Canada

[21] Appl. No.: 08/658,410

[22] Filed: Jun. 5, 1996

[51] Int. Cl.[6] ..... B27B 31/00

[52] U.S. Cl. ..... 83/156; 83/436.1; 83/436.15; 144/248.6; 198/782

[58] Field of Search ..... 83/156, 436.1, 83/436.15, 436.3, 436.6, 436.7, 732; 144/242.1, 246.1, 248.6; 198/782, 786

[56] References Cited

U.S. PATENT DOCUMENTS 1,059,235 4/1913 Tenow et al. ..... 83/436.1 X
4,061,070 12/1977 Groves .
4,144,782 3/1979 Lindstrom ..... 83/732 X
4,240,477 12/1980 Horn et al. .
4,441,537 4/1984 Vartiainen .
4,572,256 2/1986 Rautio .
4,846,334 7/1989 Cargould ..... 198/782 X
4,881,584 11/1989 Wislocker et al. .
4,907,632 3/1990 Reuter .
4,947,909 8/1990 Stroud .
5,148,847 9/1992 Knerr .
5,320,153 6/1994 Knerr .
5,400,842 3/1995 Brisson .
5,435,361 7/1995 Knerr .
5,469,904 11/1995 Kontiainen ..... 144/378 X

*Primary Examiner*—Eugenia A. Jones
*Attorney, Agent, or Firm*—Kolisch, Hartwell, Dickinson, McCormack & Heuser

[57] ABSTRACT

A feed-roll mounting mechanism for a machine which curve-cuts logs into boards, wherein the feed rolls are mounted in a fashion which permits selective lateral (axial) shifting along their rotational axes.

3 Claims, 1 Drawing Sheet

LATERALLY-FLOATING FEED-ROLL DRIVE MECHANISM FOR CURVE-CUTTING MACHINE

BACKGROUND AND SUMMARY OF THE INVENTION

This invention relates, generally, to curve-cutting of boards from a log. More particularly, it relates to the mountings provided for power-driven feed rolls that (a) feed an undivided log into a bank of curve-cutting, rotary saw blades, and (b) feed away from the cutting blades the resulting cut-into-boards products divided from the log.

Responding to the ever-growing desire in the wood-products field for the optimization of yield from logs, a technique known as curve-cutting has been developed for cutting boards from logs in a fashion whereby the paths along which boards are cut generally follow a log's curvature. A good description of the advantages of such a procedure, and of a process and an apparatus generally involved in curve-cutting, appears in U.S. Pat. No. 4,947,909, and for the purpose of providing a background for the ensuing disclosure, the entirety of this patent is incorporated herein by reference.

In order for curve-cutting to be accomplished effectively, it is important that, at a location generally immediately upstream from the infeed end of the bank of curve-cutting saw blades (or other kinds of cutters), each log, properly positioned, be urged laterally against a suitable reference datum structure so that the log's curvature, previously calculated by a computer, for example, can be followed meticulously as the log advances through the bank of blades. However, the application of a lateral positioning force to position an oncoming log against such a reference structure can effect, and often does effect, extreme lateral stressing and wearing of the support drive mechanism which is provided for the usual upstream, power-driven, clamping feed rolls (power-driven structure) which feed a log into the saw bank.

Not only does such a stressing problem occur at the infeed or upstream side of the cutting mechanism, but also, to a somewhat lesser degree (but nevertheless present) on the downstream side of the cutting mechanism where the divided-into-boards "products" are fed away from the cutting mechanism.

A general object of the present invention is to provide a mounting structure for such feed rolls which minimizes the wear and stress that has been encountered in such machines heretofore.

In particular, the present invention offers a unique, laterally-floating, clamping feed-roll drive mechanism that can accommodate, by lateral shifting of the rolls, lateral forces that are introduced into this mechanism by virtue of the passage of a log whose surface, which presents itself to the feed rolls, curves generally in the normally horizontal "plane" in which the log is being fed. For example, pairs of upper and lower power-driven feed rolls are provided according to this invention which rotate on horizontal axes that are generally transverse, or at right angles, to the direction in which a log is fed. These rolls are mounted on drive shafts through rotational locking keys which allow for limited, generally unrestrained, bidirectional, lateral (along their rotational axes) shifting of the rolls to accommodate log curvature. Spring biasing may be employed to promote nominal longitudinal positioning for the rolls. This lateral-shift accommodating structure is employed for feed rolls which are disposed both on the upstream and on the downstream sides of the cutting mechanism.

With such mechanism, as proposed by the present invention, installed in a curve-cutting machine, the kinds of damaging wear and stress mentioned above are substantially completely avoided.

These and other objects and advantages that are attained by the invention will become more fully apparent as the description which now follows is read in conjunction with the accompanying drawings.

DETAILED DESCRIPTION OF THE INVENTION

Figure 1:
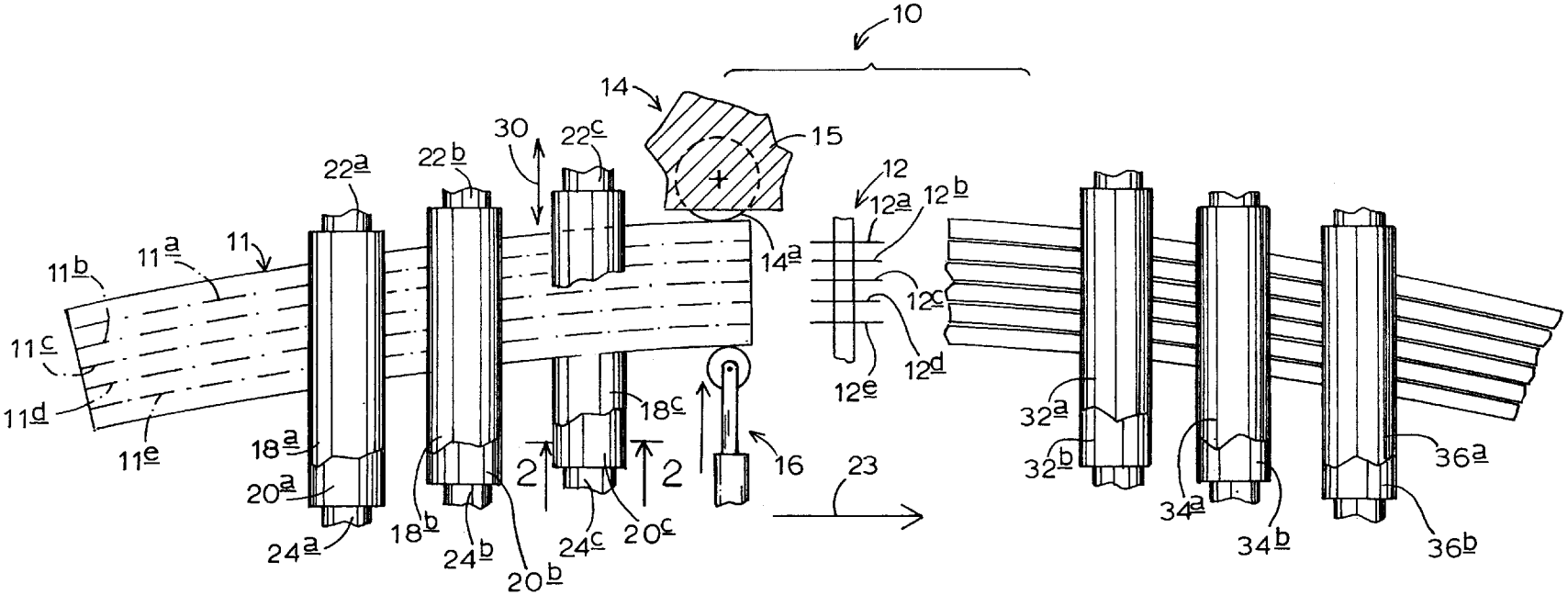
FIG. 1 is a simplified, schematic, idealized, overhead, fragmented plan view of portions of a curve-cutting machine, and more particularly of such a machine which is equipped with power-driven feed rolls that are mounted in accordance with the lateral-shift capability proposed by the present invention.

Turning now to the drawings, and referring first of all to FIG. 1, indicated generally at 10 is a fragmentary portion, shown very schematically, of a curve-cutting machine which is designed to cut logs, such as log 11, into multiple boards. It is typical and conventional that logs, before they enter a machine such as machine 10 have opposite faces "opened", by cutting, to flatten them so as to prepare what is known as a two-sided cant whose flattened, opposed faces can be directly engaged and gripped by vertically opposed drive rolls. Log. 11 herein has been so prepared, and is nevertheless referred to herein throughout as a log. One of the flattened faces of the type just mentioned is the face which appears in the plane of FIG. 1 in the drawings. Included in machine 10, as pictured in FIG. 1, is a bank of curve-cutting rotary saw blades 12, shown here to include five blades, 12*a*, 12*b*, 12*c*, 12*d*, 12*e*, a reference datum structure 14 which takes the form of an idler roller 14*a* that extends just slightly proud of an appropriate support structure 15, and a pressure-fluid-actuated, log-pressure-applying, fluid-pressure-biased roller mechanism shown generally at 16. The saw blades operate in what are referred to herein as cutting planes (normal to the plane of FIG. 1).

Figure 2:
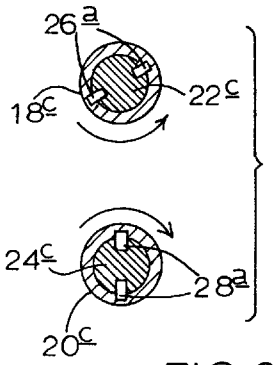
FIG. 2 is a cross-sectional view taken generally along line 2—2 in FIG. 1.

Also included in machine 10, upstream from saw bank 12, are three pairs of vertically displaced, power-driven clamping/feed rolls 18*a*, 20*a*, 18*b*, 20*b* and 18*c*, 20*c*, which are mounted, respectively, on drive shafts 22*a*, 24*a*, 22*b*, 24*b*, and 22*c*, 24*c*. Referring for a moment to FIG. 2 along with FIG. 1, these upstream feed rolls operate under power to drive a log, such as log 11, generally in the direction of arrow 23 in FIG. 1. The obvious, necessary counter-rotation of the feed rolls required to accomplish this is indicated (see FIG. 2) by the curved arrows which are pictured in FIG. 2 in relation to feed rolls 18*c*, 20*c*. Feed/clamping pressure established for the feed rolls is produced in any suitable conventional manner. Also, and in accordance with conventional practice, the cylindrical surfaces of the feed rolls are roughened, as by knurling, in order to assure appropriate drive-gripping of a log.

Continuing with FIG. 2 along with FIG. 1, rolls 18*c*, 20*c* are drivingly carried on shafts 22*c*, 24*c*, respectively, through pairs of keyway-supported keys 26*a*, 28*a*, respectively, which keys allow the rolls to shift laterally back and forth along their respective rotational axes, as indicated generally by arrow 30 in FIG. 1. Suitable springs (not shown) interposed the respective keys and keyways associated with these two rolls and their respective drive shafts nominally bias the rolls toward longitudinal central positions on these shafts. While central nominal positioning is present in machine 10, if desired, the rolls could nominally be biased toward longitudinally offset positions.

Rolls 18*a,* 20*a,* 18*b,* 20*b,* are mounted, respectively, on shafts 22*a,* 24*a,* 22*b,* 24*b,* through pairs of keys (not shown) such as just-described pair of keys 26*a,* 28*a.*

Returning principally to FIG. 1, log 11 which is about to be cut by the saw bank in machine 10 is pictured in this figure with a substantial and exaggerated curvature—bending generally in the plane of FIG. 1—the feed plane for the log. The log is intended to be cut by blades 12*a,* 12*b,* 12*c,* 12*d,* 12*e,* into six boards separated by cutting lines indicated generally at 11*a,* 11*b,* 11*c,* 11*d,* 11*e,* respectively. These cutting lines are indicated in dash-dot format in FIG. 1.

Log 11 is fed into machine 10 under the urging of the six upstream feed rolls previously mentioned and, immediately upstream from the saw bank, is urged against idler roller 14*a* in reference datum structure 14 by application of pressure via roller mechanism 16. This situation assures that the log, on engaging, and during engagement with, the saw blades, is and remains properly positioned throughout the cutting operation.

Given this situation, it will be evident that, as the log advances through the machine, and because of its curvature, it will tend to exert a lateral force on the upstream feed rolls which, in the absence of appropriate "permission" being granted (by features offered by the present invention) for these feed rolls to shift laterally, would cause stress and wear-and-tear of the kind mentioned earlier. However, according to the invention, as the log advances, the feed rolls can readily shift to accommodate the lateral curvature-induced force exerted by a log, such as log 11, and the wear, tear and stress issues are substantially nonexistent. The lateral-shifting "permission-granting" just described is illustrated in somewhat exaggerated form on the left side of FIG. 1, where one can see that the three pairs of feed rolls are longitudinally/axially offset from one another to accommodate the log's curvature. In the absence of the presence of a log between each respective pair of opposing feed rolls, these rolls return under the influence of the biasing springs mentioned earlier to their nominal, axial, central, longitudinal positions on their respective associated drive shafts.

Continuing with a description of the apparatus of the invention, and returning chief focus to what is illustrated in FIG. 1, and looking, in this regard, at what is illustrated toward and on the right-hand side of FIG. 1, located appropriately downstream from the saw bank are three more pairs of power-driven feed rolls 32*a,* 32*b,* 34*a,* 34*b,* and 36*a* 36*b.* In all respects, these three pairs of rolls are like the three pairs of rolls previously described on the upstream side of the saw bank, and, accordingly, are mounted for the same sort of lateral-shift allowance described above.

Let us, for a moment, imagine, with a bit of license, that the right side of FIG. 1 illustrates, inter alia, the condition of log 11 after cutting into boards. As can be seen in this right-hand portion of FIG. 1, wherein the emerging cut wood is shown with fragmented ends, there exist six kerf-separated boards, which still, of course, have some curvature (shown in very exaggerated form). These boards are fed away from the saw bank by the downstream feed rolls which shift as necessary longitudinally along their respective associated drive shafts to accommodate such curvature. The three pairs of downstream feed rolls in FIG. 1 are staggered in a fashion which accommodates this curvature.

It should be very apparent, now, from the description which has just been given of the present invention, which description should be read carefully in conjunction with the drawing figures, that the invention offers the possibility of implementing very effective curve-cutting of a log under circumstances which minimize if not substantially completely eliminate the kind of feed-roll support stressing which has been mentioned earlier.

Thus, and while the apparatus of the invention has been described and illustrated herein in highly schematic form, it will be very evident to those who are skilled in this art that there are many ways in which clamping/feed rolls, such as rolls discussed herein, can be mounted for appropriate bidirectional lateral shiftability to prevent the problems discussed above.

Accordingly, while a preferred embodiment of the invention has been generally described, it is appreciated that variations and modifications may be made without departing form the spirit of the invention.

It is claimed and desired to secure by Letters Patent:

1. Power-driven feed structure for feeding an elongate wood workpiece endo to cutters in a curve-cutting machine comprising, an upstream clamping-roll mechanism including opposed clamping rolls, at least one of which is a power-driven roll, clampingly and drivingly engageable with the workpiece upstream from the cutters, with the rotational axis of each roll in the clamping-roll mechanism extending generally transversely of the long axis of each engaged workpiece, and lateral shift-accommodating mounting structure for said clamping-roll mechanism, said mounting structure mounting each of said opposed rolls for free, bidirectional, operative, lateral, workpiece-following movement generally along the rotational axis of each of said opposed rolls.

2. The feed structure of claim 1, which further includes an additional clamping-roll mechanism located downstream from the cutters, and additional mounting structure for said additional clamping-roll mechanism mounting additional opposed rolls therein, each of said additional opposed rolls being mounted by said additional mounting structure for free, bidirectional, operative, lateral, workpiece-following movement generally along a rotational axis of each of said additional opposed rolls.

3. Power-driven feed structure for feeding an elongate workpiece endo into a cutting station in a cutting machine under circumstances where, for any reason, the feeding results in a tendency for the workpiece to shift laterally relative to the cutting station, said structure comprising clamping-roll mechanism disposed upstream from the cutting station and including opposed clamping rolls, at least one of which is a power-driven roll clampingly and rotationally drivingly engagable with the workpiece immediately upstream from the cutting station for the endo feeding of the workpiece through the cutting station, with a rotational axis of each of said opposed clamping rolls extending generally transversely of the long axis of each engaged workpiece and in a direction generally paralleling the direction of the lateral shift of the workpiece, and lateral shift-accommodating mounting structure in said clamping-roll mechanism, said mounting structure mounting each of said opposed clamping rolls for free, bidirectional, operative, lateral, workpiece-following movement generally along a rotational axis of each of said opposed clamping rolls.

* * * * *